US009190229B2

(12) United States Patent
Branch

(10) Patent No.: US 9,190,229 B2
(45) Date of Patent: Nov. 17, 2015

(54) IMPACT SWITCH

(71) Applicant: ShockWatch, Inc., Dallas, TX (US)

(72) Inventor: Clinton A. Branch, Jacksboro, TX (US)

(73) Assignee: ShockWatch, Inc., Dallas, TX (US)

( * ) Notice: Subject to any disclaimer, the term of this patent is extended or adjusted under 35 U.S.C. 154(b) by 269 days.

(21) Appl. No.: 13/889,423

(22) Filed: May 8, 2013

(65) Prior Publication Data

US 2013/0299322 A1 Nov. 14, 2013

Related U.S. Application Data

(60) Provisional application No. 61/644,302, filed on May 8, 2012.

(51) Int. Cl.
*H01H 29/00* (2006.01)
*H01H 29/22* (2006.01)

(52) U.S. Cl.
CPC ..... *H01H 29/002* (2013.01); *H01H 29/22* (2013.01)

(58) Field of Classification Search
CPC ..... H01H 35/14; H01H 29/04; H01H 31/122; H01H 31/12
USPC ..... 200/209–215, 182–183, 191–194, 221, 200/222; 116/203
See application file for complete search history.

(56) References Cited

U.S. PATENT DOCUMENTS 1,598,877 A * 9/1926 Phelan et al. ..... 200/225
2,825,297 A 3/1958 Harrison
2,976,732 A 3/1961 Hautly
3,021,813 A 2/1962 Rips
3,312,188 A 4/1967 Lode et al.
3,373,716 A 3/1968 Williams
3,461,730 A 8/1969 Peters
3,623,449 A 11/1971 Knutson
3,707,722 A 12/1972 Itoh
3,782,204 A 1/1974 Boardman
3,909,568 A 9/1975 Greenhug
4,068,613 A 1/1978 Rubey
4,072,835 A * 2/1978 Burke ..... 200/61.47
4,125,085 A 11/1978 Rubey
4,177,751 A 12/1979 Rubey
4,219,708 A 8/1980 Rubey
(Continued)

FOREIGN PATENT DOCUMENTS

JP 2006300768 11/2006
JP 2006300768 A * 11/2006
WO 2008060003 5/2008

OTHER PUBLICATIONS

Translation of Haga.*

*Primary Examiner* — Briggitte R Hammond
*Assistant Examiner* — Doblade Elliott
(74) *Attorney, Agent, or Firm* — James L. Baudino

(57) ABSTRACT

According to one aspect of the present disclosure, a device and technique for an impact switch is disclosed. The impact switch includes a first member having a reservoir for holding a conductive fluid and a second member having a first conductive portion disconnected from a second conductive portion. The second member is coupled to the first member over the reservoir. Responsive to receiving a predetermined level of impact, the conductive fluid moves from the reservoir to an interface between the first and second members to conductively connect the first conductive portion with the second conductive portion.

18 Claims, 6 Drawing Sheets

(56) References Cited

U.S. PATENT DOCUMENTS

| | | | | |
|---|---|---|---|---|
| 4,237,736 | A | 12/1980 | Wright | |
| 4,239,014 | A | 12/1980 | Rubey | |
| 4,361,106 | A | 11/1982 | Eklof | |
| 4,528,851 | A * | 7/1985 | Ozols | 200/61.47 |
| 4,688,244 | A | 8/1987 | Hannon et al. | |
| 4,943,690 | A * | 7/1990 | Bitko | 200/61.47 |
| 4,982,684 | A | 1/1991 | Rubey | |
| 5,027,105 | A | 6/1991 | Dailey et al. | |
| 5,051,725 | A | 9/1991 | Caccitolo | |
| 5,153,561 | A | 10/1992 | Johnson | |
| 5,323,729 | A | 6/1994 | Rubey | |
| 5,347,274 | A | 9/1994 | Hassett | |
| 5,351,539 | A | 10/1994 | Ziegenbein et al. | |
| 6,272,901 | B1 | 8/2001 | Takeuchi et al. | |
| 6,301,718 | B1 | 10/2001 | Rigal | |
| 6,313,417 | B1 * | 11/2001 | Schnell | 200/61.47 |
| 6,314,907 | B1 | 11/2001 | Harris et al. | |
| 6,367,408 | B1 * | 4/2002 | Gu | 116/203 |
| 6,685,094 | B2 | 2/2004 | Cameron | |
| 6,698,272 | B1 | 3/2004 | Almirante | |
| 6,848,389 | B1 | 2/2005 | Elsasser et al. | |
| 7,119,759 | B2 | 10/2006 | Zehner et al. | |
| 7,219,619 | B2 | 5/2007 | Fitzer et al. | |
| 7,353,615 | B1 | 4/2008 | Branch | |
| 7,509,835 | B2 | 3/2009 | Beck | |
| 7,918,179 | B2 | 4/2011 | Pan et al. | |
| 8,074,489 | B2 | 12/2011 | Ishikawa et al. | |
| 8,234,994 | B1 | 8/2012 | Branch | |
| 8,387,552 | B2 * | 3/2013 | Branch | 116/203 |
| 2005/0039669 | A1 | 2/2005 | Elsasser et al. | |
| 2007/0194943 | A1 | 8/2007 | Fitzer et al. | |
| 2011/0139060 | A1 | 6/2011 | Sheau-Shi et al. | |
| 2011/0219852 | A1 | 9/2011 | Kasten | |
| 2012/0312224 | A1 | 12/2012 | Branch | |

* cited by examiner

IMPACT SWITCH

BACKGROUND

During storage, transit or use, many types of objects need to be monitored due to the sensitivity or fragility of the objects. For example, some types of objects may be susceptible to damage if dropped or a significant impact is received. Thus, for quality control purposes and/or the general monitoring of transportation/use conditions, it is desirable to determine and/or verify the environmental conditions to which the object has been exposed. For example, for some types of devices, the receipt of a shock or impact event may affect a warranty for repair or replacement of the device.

BRIEF SUMMARY

According to one aspect of the present disclosure, a device and technique for an impact switch is disclosed. The impact switch includes a first member having a reservoir for holding a conductive fluid and a second member having a first conductive portion disconnected from a second conductive portion. The second member is coupled to the first member over the reservoir. Responsive to receiving a predetermined level of impact, the conductive fluid moves from the reservoir to an interface between the first and second members to conductively connect the first conductive portion with the second conductive portion.

According to another embodiment of the present disclosure, an impact switch includes an insert having a reservoir for holding a conductive fluid, the reservoir sized to retain the conductive fluid in the reservoir until a predetermined level of impact is received by the impact switch. The impact switch also includes an electronic assembly disposed over an opening of the reservoir, the electronic assembly having a first conductive portion extending over a first portion of a periphery of the opening and a second conductive portion extending over a second portion of the periphery of the opening, the first and second conductive portions disconnected from each other in a non-activated state of the impact switch. Responsive to receiving the predetermined level of impact, the conductive fluid moves from the reservoir to an interface between the insert and the electronic assembly and migrates along the periphery to conductively connect the first conductive portion with the second conductive portion in an activated state.

BRIEF DESCRIPTION OF THE SEVERAL VIEWS OF THE DRAWINGS

For a more complete understanding of the present application, the objects and advantages thereof, reference is now made to the following descriptions taken in conjunction with the accompanying drawings, in which.

DETAILED DESCRIPTION

Embodiments of the present disclosure provide a device and technique for an impact switch. According to one embodiment, an impact switch includes a first member having a reservoir for holding a conductive fluid and a second member having a first conductive portion disconnected from a second conductive portion. The second member is coupled to the first member over the reservoir. Responsive to receiving a predetermined level of impact, the conductive fluid moves from the reservoir to an interface between the first and second members to conductively connect the first conductive portion with the second conductive portion. Embodiments of the present disclosure provide an impact switch that functions as a shock fuse such that, in response to receipt of a particular level and/or magnitude of a shock/acceleration event, conductive fluid closes the switch/fuse to enable an electronic signal to be generated/detected evidencing the receipt of the shock/acceleration event. Embodiments of the present disclosure also provide a passive impact sensor that can be used as part of an electronic signal or circuit. The impact sensing capabilities/functions of the impact switch of the present disclosure need no power while in the monitoring state. When activated, the impact switch can be used to complete an electrical path of a circuit and thus could be integrated into most any electronic monitoring system. Thus, the impact switch of the present disclosure provides an easily assembled and low cost passive impact sensing device.

Figure 1:
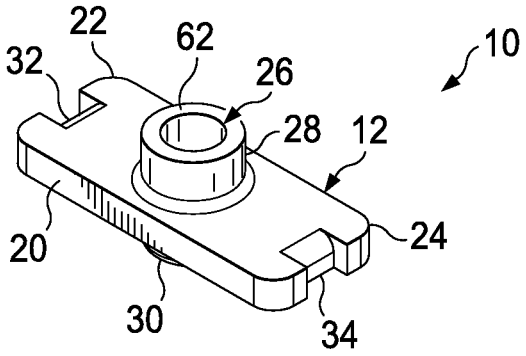
FIG. 1 is a diagram illustrating an isometric view of an embodiment of an insert of an impact switch according to the present disclosure.
Figure 2:
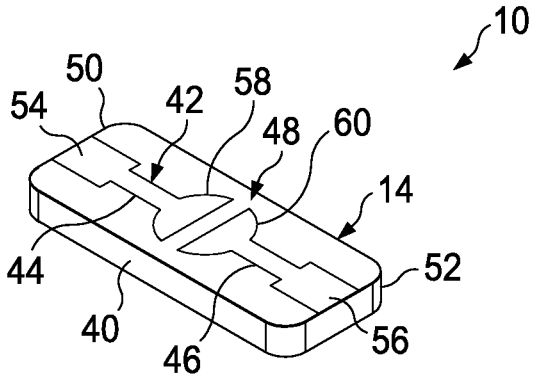
FIG. 2 is a diagram illustrating an isometric view of an embodiment of an electronic assembly of an impact switch according to the present disclosure.
Figure 3:
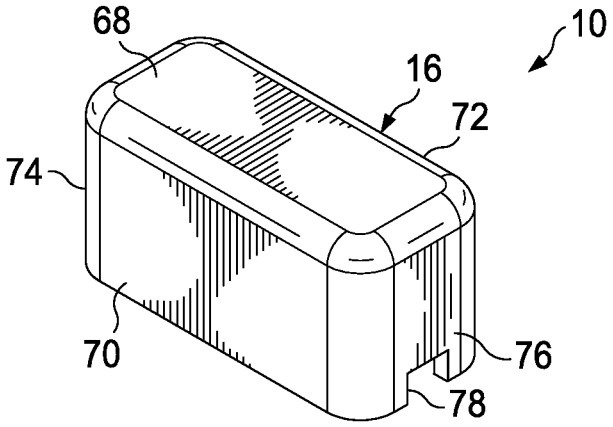
FIG. 3 is a diagram illustrating an isometric view of an embodiment of a cover of an impact switch according to the present disclosure.

With reference now to the Figures and in particular with reference to FIGS. 1, 2 and 3, component parts of an embodiment of an impact switch 10 are illustrated according to an embodiment of the present disclosure. FIG. 1 is a diagram illustrating an isometric view of an embodiment of an insert 12 according to the present disclosure, FIG. 2 is a diagram illustrating an isometric view of an embodiment of an electronic assembly 14 according to the present disclosure, and FIG. 3 is a diagram illustrating an isometric view of an embodiment of a cover 16 according to the present disclosure.

In FIGS. 1, 2 and 3, impact switch 10 is a device configured to be affixed to or disposed within an electronic device of which impact and/or acceleration events associated therewith are to be monitored. Embodiments of impact switch 10 monitor whether an object/device has been exposed to an impact or some level of an acceleration event. In some embodiments, impact switch 10 may be affixed (permanently or removably) to a printed circuit board and/or otherwise permanently or removably connected to electronic circuitry (e.g., such as a removable cartridge) such that, in response to receipt and/or detection of an acceleration event or impact condition of a sufficient magnitude, impact switch 10 provides an electronic switch closure that may thereby provide an electronic signal/indication of such event.

Referring to FIG. 1, insert 12 includes a flange body 20 having oppositely disposed extension portions 22 and 24. Insert 12 also includes a reservoir 26 formed by a cylindrical wall 28 extending upwardly from flange body 20 between portions 22 and 24. In FIG. 1, reservoir 26 is cylindrically shaped; however, it should be understood that other geometric shapes may be used to form reservoir 26. On an opposite side of flange body 20 from reservoir 26, an extension member 30 extends downwardly from flange body 20. On each end of extension portions 22 and 24 resides a cut-out portion or recess 32 and 34, respectively. As will be described in greater detail below, recesses 32 and 34 provide a passage for electrical leads and/or connections to be made and/or to extend to electronic assembly 14. In some embodiments, insert 12 is formed from a polymer material; however, it should be understood that other types of material may also be used (e.g., in at least certain portions of inserts, non-conductive materials).

Referring to FIG. 2, electronic assembly 14 comprises a printed circuit board 40 having a split etch trace or pad 42 located on at least one side thereof. In the illustrated embodiment, pad 42 comprises traces and/or conductive portions 44 and 46 that are disconnected from each other in a medially located area 48. In the illustrated embodiment, conductive portions 44 and 46 extend in opposite directions from each other toward respective ends 50 and 52 of board 40. Each conductive portion 44 and 46 includes connection and/or solder points 54 and 56, respectively, to enable conductive portions 44 and 46 to be electrically connected to another device(s) (e.g., external electrical circuitry). In the illustrated embodiments, conductive portions 44 and 46 each comprise a split portion 58 and 60, respectively, spaced apart from each other near area 48. The shape and/or configuration of split portions 58 and 60 may vary. Split portions 58 and 60 are located in area 48 such that at least a portion of each split portion 58 and 60 extends over and/or is located proximate to an upper peripheral surface 62 of reservoir 26 (FIG. 1) when board 40 is located proximate to and/or coupled to insert 12 (e.g., conductive portions 44 and 46 facing insert 12 and/or reservoir 26).

Referring to FIG. 3, cover 16 comprises a top wall 68 and downwardly extending sidewalls 70, 72, 74 and 76. Each sidewall 74 and 76 includes a cut-out or recess 78 to enable electronic assembly 14, when located within cover 16, to be electrically connected to another device(s) (e.g., external electrical circuitry).

Figure 5:
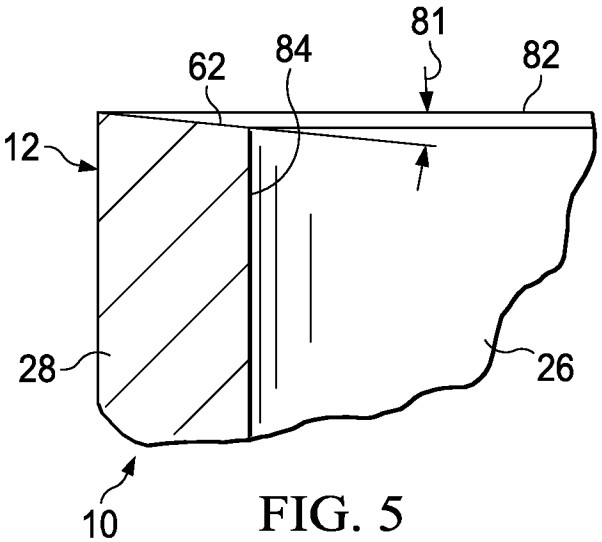
FIG. 5 is an enlarged view of a portion of the insert illustrated in FIG. 4 according to the present disclosure.
Figure 4:
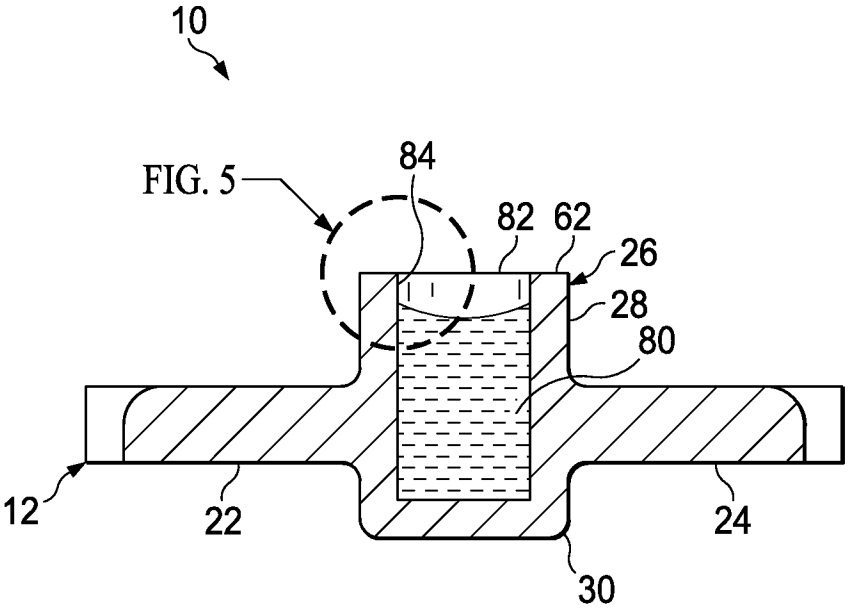
FIG. 4 is a diagram illustrating a partial section view of the insert of FIG. 1 according to the present disclosure.

FIG. 4 is a diagram illustrating a partial section view of an embodiment of insert 12 of FIG. 1 according to the present disclosure, and FIG. 5 is an enlarged view of a portion of insert 12 illustrated in FIG. 4 according to the present disclosure. In the illustrated embodiment, reservoir 26 is configured/formed for holding or containing therein a conductive fluid 80 that is used to provide an indication in response to impact switch 10 being subjected to and/or otherwise experiencing a predetermined level of impact or acceleration event. In some embodiments, wall 28 is formed slightly drafted, rounded or angled having a tapered and/or angled wall configuration 81 (FIG. 5) extending inwardly along an opening 82 of reservoir along upper peripheral surface 62 such that, upon locating opening 82 toward and/or against board 40, a capillary gap is formed at an interface between area 48 and surface 62 (e.g., a mouth of reservoir 26 at or near surface 62 to provide a defined path/gap for conductive fluid 80 to wick into). The taper or draft angle may be approximately one to four degrees or another suitable draft angle or shape. In some embodiments, surface 62 may be formed without being tapered and/or may be formed having a matted surface finish such that surface irregularities corresponding to the matted surface finish of surface 62 form the capillary gap between surface 62 and area 48 of board 40. For example, in some embodiments, when assembled, board 40 is located adjacent insert 12 such that surface 62 is placed into contact with area 48 of board 40. The surface irregularities of surface 62 form a capillary gap between surface 62 and area 48 of board 40. It should also be understood that surface irregularities on board 40 may also be utilized to form the capillary gap. Additionally, it should be understood that in some embodiments, board 40 may be secured to insert 12 at a certain location, distance or position to form a capillary gap of a desired size. In some embodiments, the capillary gap is sized to be between 0.001 and 0.005 inches; however, it should be understood that other sizes, greater or smaller, of the capillary gap may be used (e.g., based at least partly on a viscosity of conductive fluid 80, surface variations on surface 62 and/or area 48, etc.).

In some embodiments, conductive fluid 80 comprises a mixture and/or combination of water and calcium chloride; however, it should be understood that other types and/or mixtures of conductive fluids may be used to accommodate a desired impact sensitivity, temperature condition, etc. For example, in operation, conductive fluid 80 is held or retained in reservoir 26 by surface tension of conductive fluid 80. The conductive fluid 80 forms a meniscus with an interior wall surface 84 of reservoir 26. In response to receiving and/or experiencing a sufficient magnitude of impact or acceleration event, the meniscus contorts or ruptures, thereby causing at least a portion of conductive fluid 80 to splash or flow out of reservoir 26 toward board 40. Upon contact of conductive fluid 80 with area 48 of board 40 and/or conductive fluid 80 reaching an interface between surface 62 and board 40, the capillary gap formed between board 40 and surface 62 causes conductive fluid 80 wick into the capillary gap by capillary action (e.g., because of inter-molecular attractive forces between the fluid and solid surrounding surfaces) and migrate along the periphery of surface 62 around opening 82. As will be described in greater detail below, the migration of conductive fluid 80 In some embodiments, The amount of surface tension of conductive fluid 80 to reservoir 26 can be controlled to result in a release of conductive fluid 80 (e.g., a distortion or rupture of a meniscus of conductive fluid 80 with surface 84) in response to a certain impact or acceleration level or magnitude. For example, a material of insert 12 (e.g., the material forming reservoir 26), the size or diameter of reservoir 26, and/or a viscosity of conductive fluid 80 may be selected to have a desired surface tension to reservoir 26, thereby needing a certain magnitude of impact or acceleration event to cause a distortion or disruption of the meniscus of conductive fluid 80 to cause conductive fluid 80 to wick into a capillary gap between surface 62 and area 48 of board 40. For example, as the bore size/diameter of reservoir 26 is reduced, a higher magnitude of acceleration is generally needed to rupture a meniscus corresponding to conductive fluid 80 in contact with surface 84 and release conductive fluid 80 toward board 40. For example, there are generally two factors that influence conductive fluid 80's response to acceleration—viscosity and surface tension. Viscosity influences a fluid's ability to quickly deform and change shape. Surface tension influences a fluid's affinity and adhesion to itself or an external surface. There is generally a finite range over which the viscosity of a fluid can be varied and significantly affect the activation or impact sensitivity. For example, in some embodiments, this range may be approximately between twenty centistokes and eighty centistokes, depending on the internal bore diameter of reservoir 26. However, it should be understood that other viscosities or viscosity ranges may be utilized based on a selected bore size of reservoir 26. Additionally, in some embodiments, calcium chloride used in conductive fluid 80 lowers the freezing point of conductive fluid 80, increases the wetting capability of conductive fluid 80, and provides electrical conductivity.

Figure 6A:
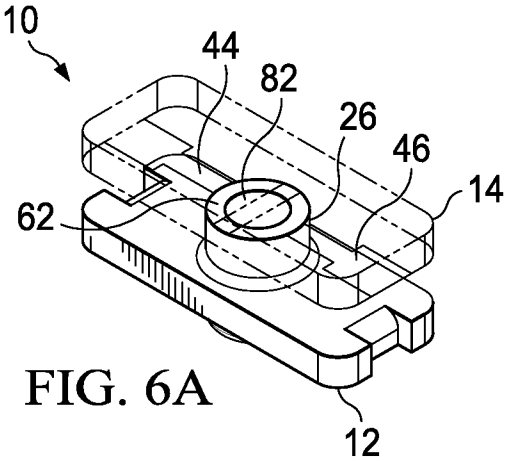
FIGS. 6A-6D are diagrams illustrating various stages of impact activation of an impact switch according to the present disclosure.
Figure 6B:
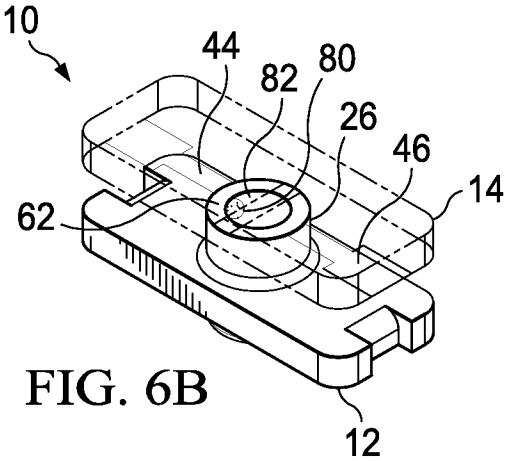
Figure 6C:
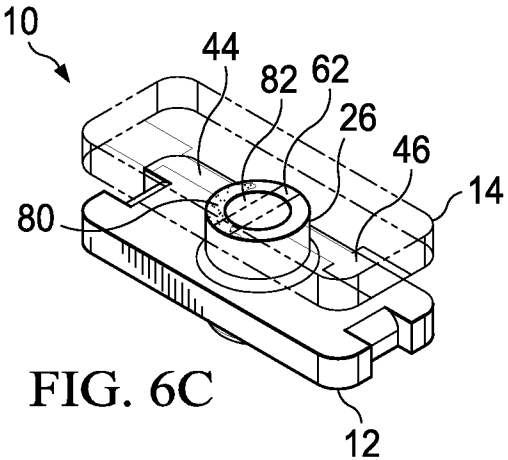
Figure 6D:
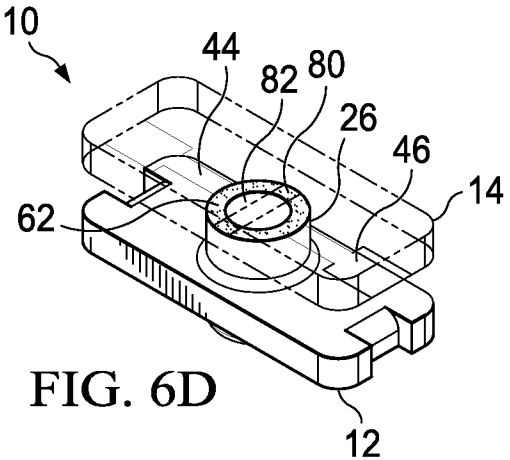

FIGS. 6A-6D are diagrams illustrating migration of conductive fluid 80 relative to electronic assembly 14 in response to impact switch 10 being subjected to a sufficient magnitude of impact or acceleration event. Referring to FIG. 6A, impact switch 10 is illustrated in a non-activated state (with electronic assembly 14 depicted in phantom lines) such that conductive fluid 80 is located/retained within reservoir 26. For ease of description and clarity, impact switch 10 is illustrated without cover 16 in FIGS. 6A-6D; however, it should be understood that, in operation, cover 16 may be enclosing both insert 12 and electronic assembly 14 therein with electronic assembly 14 coupled to and/or in close proximity to opening 82 of insert 12. In FIG. 6B, in response to impact switch 10 being subjected to a sufficient magnitude of impact or acceleration event, the meniscus of conductive fluid 80 with reservoir 26 is contorted or disrupted causing conductive fluid 80 to reach an interface common to surface 62 of opening 82 and begins to wick into a capillary gap formed between surface 62 and area 48 of board 40 (FIG. 2) by capillary action at the interface between surface 62 and area 48. Referring to FIGS. 6C and 6D, the capillary action caused by the capillary gap causes conductive fluid 80 to migrate and/or wick around the upper periphery of opening 80 along the interface relative to surface 62 and fill (or substantially fill) the interface between surface 62 and electronic assembly 14 in the areas of split portions 58 and 60 (FIG. 2) of conductive portions 44 and 46 and surface 62. As conductive fluid 80 migrates around opening 82 about surface 62, conductive fluid 80 will extend about opening 82 to the extent that conductive fluid 80 bridges the gap/spacing between conductive portions 44 and 46 and thereafter conductively connect conductive portions 44 and 46 (e.g., conductive fluid 80 need only wick into an area that provides a conductive bridging across split etch pad 42 (FIG. 2)). For example, in operation, electronic assembly 14 is located in contact with and/or in close proximity to insert 12 such that opening 82 of reservoir 26 covers split etch pad 42 (FIG. 2) on electronic assembly 14. In response to an impact event, conductive fluid 80 migrates to the mouth/opening 82 of reservoir 26 and comes into contact with electronic assembly 14. Upon contact of conductive fluid 80 with electronic assembly 14, capillary action at the interface between surface 62 and electronic assembly 14 causes conductive fluid 80 to wick into and around the interface of reservoir 26 and electronic assembly 14 and eventually bridge the gap/space between conductive portions 44 and 46, which can then be electronically detected as a high resistance switch closure (e.g., via external electronic circuitry connected to electronic assembly 14).

Figure 7B:
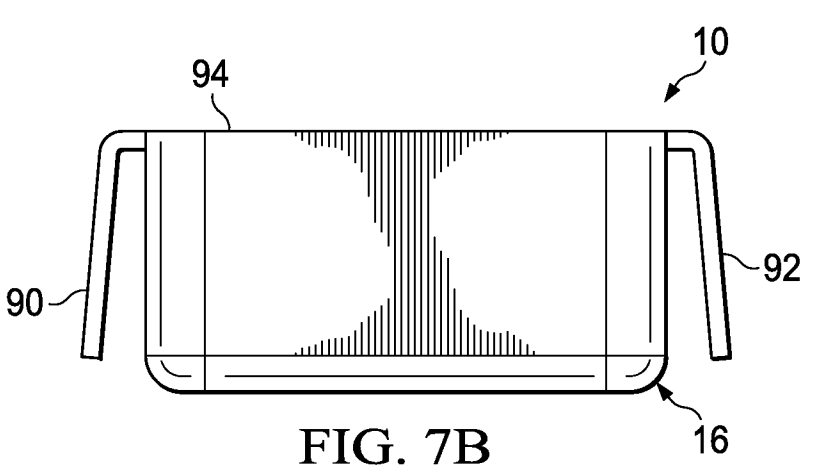
FIG. 7B is a diagram illustrating an assembled view of the impact switch of FIG. 7A according to the present disclosure.
Figure 7C:
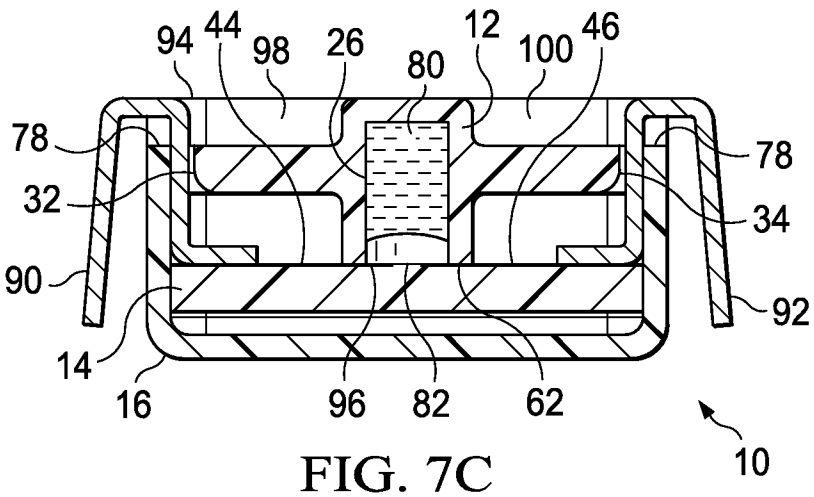
FIG. 7C is a diagram illustrating a section view of the impact switch illustrated in FIGS. 7A and 7B according to the present disclosure.
Figure 7A:
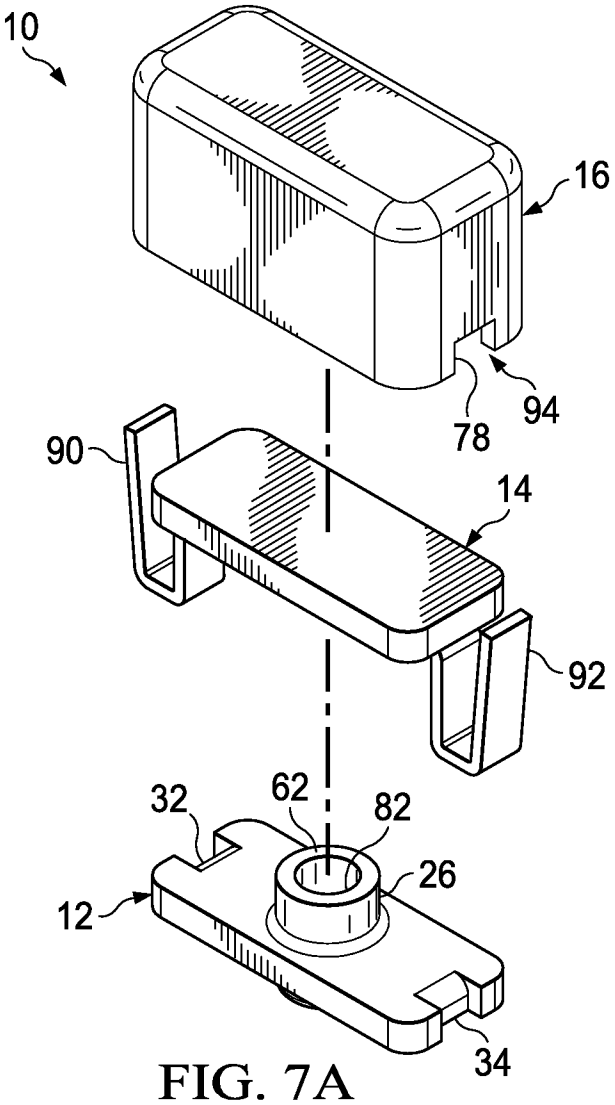
FIG. 7A is a diagram illustrating an exploded assembly view of an embodiment of an impact switch according to the present disclosure.

FIG. 7A is a diagram illustrating an exploded assembly view of an embodiment of impact switch 10 according to the present disclosure, FIG. 7B is a diagram illustrating an assembled view of impact switch 10 of FIG. 7A according to the present disclosure, and FIG. 7C is a diagram illustrating a section view of impact switch 10 illustrated in FIGS. 7A and 7B according to the present disclosure. In the illustrated embodiment, a pair of electrically conductive leads 90 and 92 are connected to electronic assembly 14 (e.g., lead 90 connected to solder point 54, and lead 92 connected to solder point 56 (FIG. 2)). In the illustrated embodiment, electronic assembly 14 is slidably inserted into cover 16 such that conductive portions 44 and 46 are facing outwardly toward an opening 94 of cover 16. Leads 90 and 92 also extend outwardly from cover 16 through recesses 78 of cover 16 to enable electronic assembly 14 to be connected to external electronic circuitry.

Insert 12 is then slidably inserted into cover 16, with conductive fluid 80 within reservoir 26, with opening 82 facing conductive portions 44 and 46 of electronic assembly 14. Leads 90 and 92 also extend through recesses 32 and 34 of electronic assembly 14. In some embodiments, insert 12 is inserted into cover 16 until opening 82 is located in contact with and/or in close proximity to electronica assembly 14, thereby forming a capillary gap 96 at the interface of surface 62 and a surface of electronic assembly 14 (e.g., area 48 (FIG. 2)) facing opening 82. In some embodiments, electronic assembly 14 and insert 12 are fixedly secured within cover 16 by filling/potting areas 98 and 100 with a material to provide a hermetic seal of electronic assembly 14 and insert 12 within cover 16. However, it should be understood that other methods and/or materials may be used to secure electronic assembly 14 and insert 12 within cover 16 (e.g., fasteners, epoxies, adhesives, etc.). Thus, in the embodiment illustrated in FIGS. 7A-7C, impact switch 10 is configured in the form of a cartridge assembly enabling impact switch 10 to be connected and/or disconnected from electronic circuitry (e.g., removed and replaced after activation).

Figure 8B:
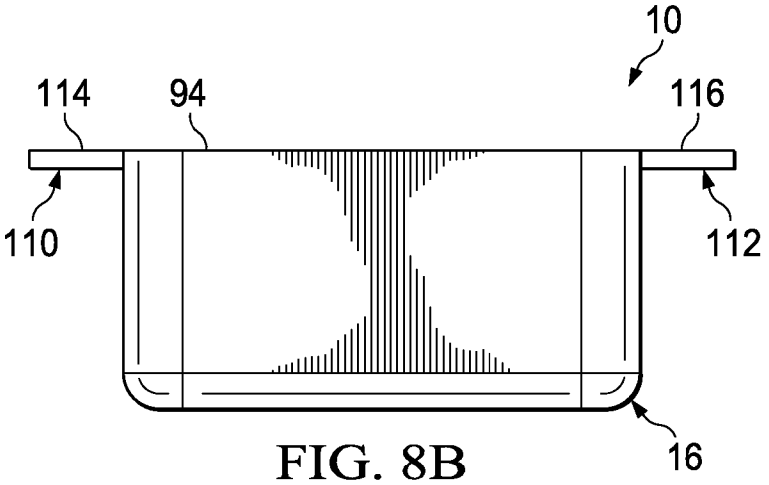
FIG. 8B is a diagram illustrating an assembled view of the impact switch of FIG. 8A according to the present disclosure.
Figure 8C:
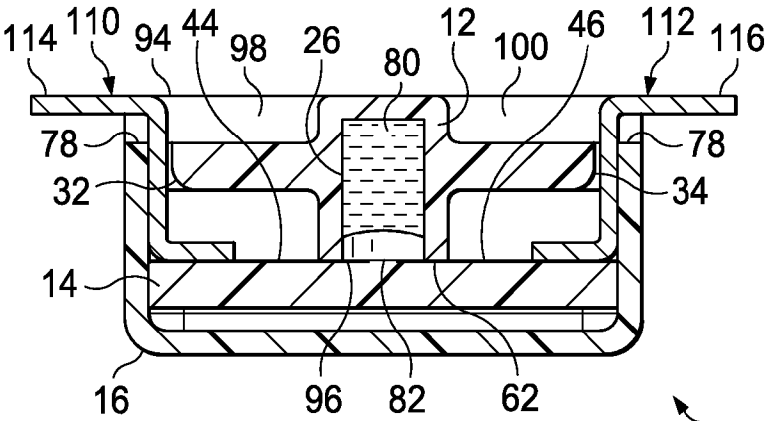
FIG. 8C is a diagram illustrating a section view of the impact switch illustrated in FIGS. 8A and 8B according to the present disclosure.
Figure 8A:
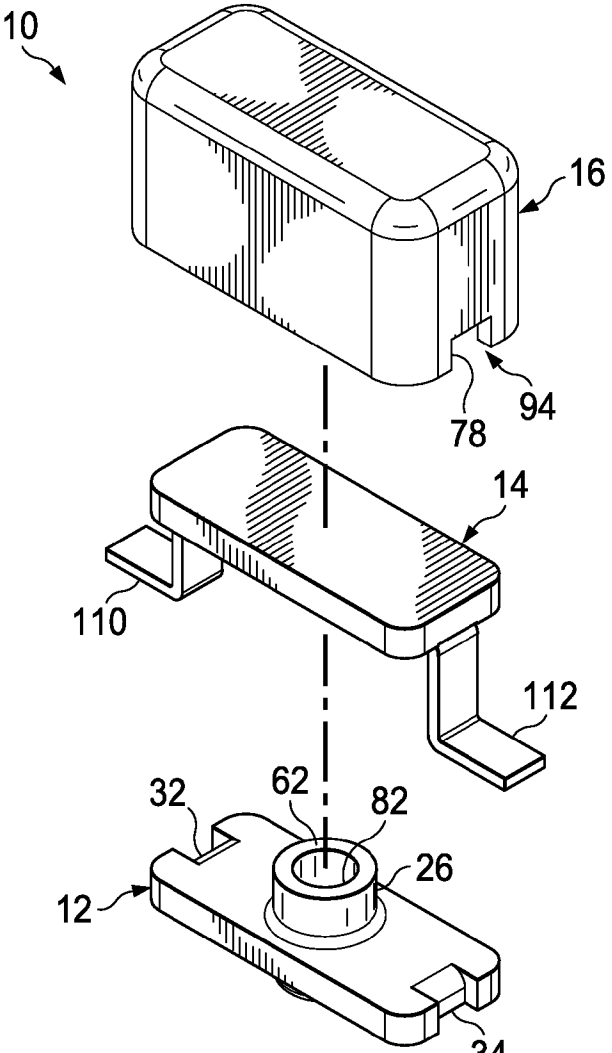
FIG. 8A is a diagram illustrating an exploded assembly view of another embodiment of an impact switch according to the present disclosure.

FIG. 8A is a diagram illustrating an exploded assembly view of another embodiment of impact switch 10 according to the present disclosure, FIG. 8B is a diagram illustrating an assembled view of impact switch 10 of FIG. 8A according to the present disclosure, and FIG. 8C is a diagram illustrating a section view of impact switch 10 illustrated in FIGS. 8A and 8B according to the present disclosure. In the illustrated embodiment, a pair of Z-shaped leads 110 and 112 are attached to electronic assembly 14 (e.g., lead 110 connected to solder point 54, and lead 112 connected to solder point 56 (FIG. 2)) and extend outwardly from cover 16 to enable electronic assembly 14 to be connected to external electronic circuitry. For example, in the illustrated embodiment, outwardly extending portions 114 and 116 of respective leads 110 and 112 enable impact switch 10 to be surface mounted to an electronic circuit board assembly or other type of electronic component/device (e.g., via soldering, fasteners, clips, etc.).

Figure 9B:
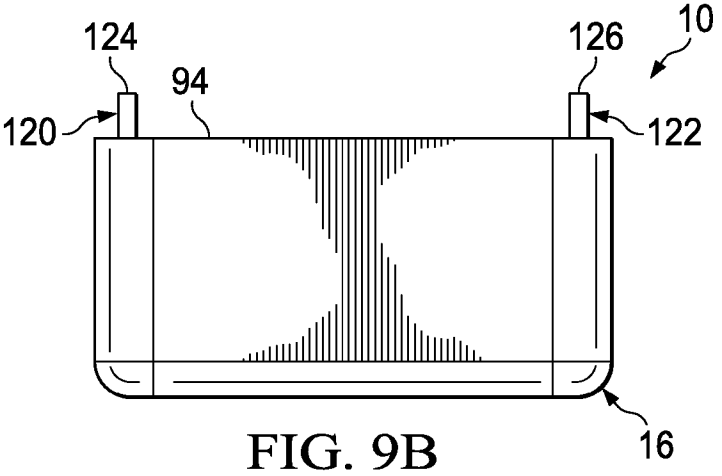
FIG. 9B is a diagram illustrating an assembled view of the impact switch of FIG. 9A according to the present disclosure.
Figure 9C:
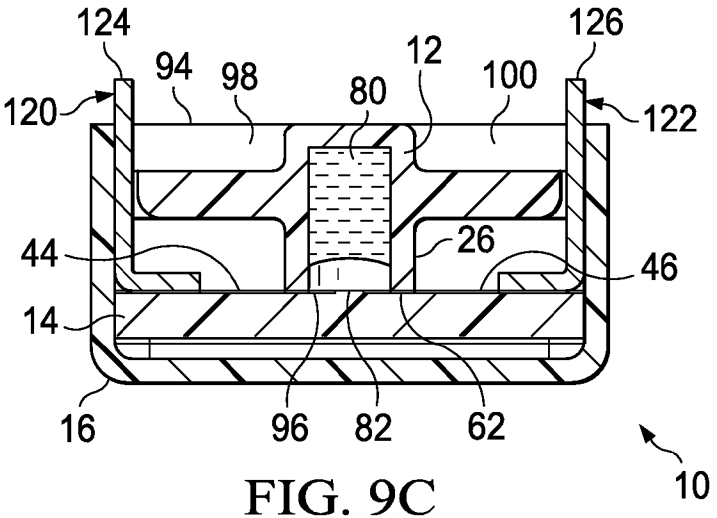
FIG. 9C is a diagram illustrating a section view of the impact switch illustrated in FIGS. 9A and 9B according to the present disclosure.
Figure 9A:
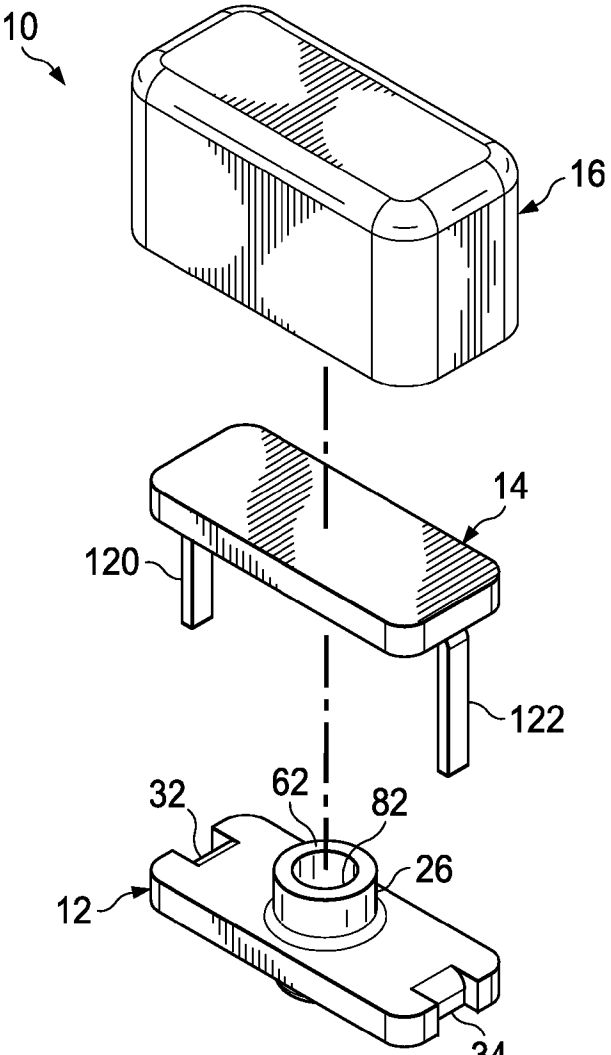
FIG. 9A is a diagram illustrating an exploded assembly view of another embodiment of an impact switch according to the present disclosure.

FIG. 9A is a diagram illustrating an exploded assembly view of another embodiment of impact switch 10 according to the present disclosure, FIG. 9B is a diagram illustrating an assembled view of impact switch 10 of FIG. 9A according to the present disclosure, and FIG. 9C is a diagram illustrating a section view of impact switch 10 illustrated in FIGS. 9A and 9B according to the present disclosure. In the illustrated embodiment, a pair of L-shaped leads 120 and 122 are attached to electronic assembly 14 (e.g., lead 120 connected to solder point 54, and lead 122 connected to solder point 56 (FIG. 2)) and extend outwardly from cover 16 to enable electronic assembly 14 to be connected to external electronic circuitry. For example, in the illustrated embodiment, outwardly extending portions 124 and 126 of respective leads 120 and 122 enable impact switch 10 to be inserted into vias and/or holes located in an electronic circuit board assembly (e.g., soldered thereto) or other type of electronic component/device. In the illustrated embodiment, recesses 78 have also been omitted from cover 16.

Thus, embodiments of the present disclosure provide an impact switch that functions as a shock fuse such that, in response to receipt of a particular level and/or magnitude of a shock/acceleration event, conductive fluid closes the switch/fuse to enable an electronic signal to be generated/detected evidencing the receipt of the shock/acceleration event. Embodiments of the present disclosure may be permanently attached/secured to external electronic circuitry (such as mounted to a printed circuit board) or configured as a replaceable device such that the entire impact switch 10 may be replaced once activated.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An impact switch, comprising:

a first member having a reservoir for holding a conductive fluid, wherein the conductive fluid comprises a combination of water and calcium chloride; and a second member having a first conductive portion disconnected from a second conductive portion, the second member coupled to the first member over the reservoir; and wherein, responsive to receiving a predetermined level of impact, the conductive fluid moves from the reservoir to an interface between the first and second members to conductively connect the first conductive portion with the second conductive portion.

2. The impact switch of claim 1, wherein a size of the reservoir and a viscosity of the conductive fluid are selected to obtain a desired activation sensitivity for the predetermined level of impact.

3. The impact switch of claim 1, wherein a mouth of the reservoir proximate to the second member comprises an angled surface to provide a capillary gap for the conductive fluid to wick into to conductively connect the first conductive portion with the second conductive portion.

4. The impact switch of claim 1, wherein each of the first and second conductive portions comprise connection points for electrically connecting the first and second conductive portions to an external device.

5. The impact switch of claim 1, wherein the first and second members are insertable into a cover.

6. The impact switch of claim 5, further comprising a first lead coupled to the first conductive portion and a second lead coupled to the second conductive portion, the first and second leads extending out of the cover.

7. An impact switch, comprising:

a first member having a reservoir for holding a conductive fluid; and a second member having a first conductive portion disconnected from a second conductive portion, the second member coupled to the first member over an opening of the reservoir, wherein a capillary gap is formed over at least a portion of an interface between the first and second members, and wherein the second member comprises a printed circuit board having a split etch pad, the split etch pad forming the disconnected first and second conductive portions; and wherein, responsive to receiving a predetermined level of impact, the conductive fluid moves from the reservoir to the interface and wicks into the capillary gap, the conductive fluid migrating within the capillary gap to conductively connect the first conductive portion with the second conductive portion.

8. The impact switch of claim 7, wherein a size of the reservoir and a viscosity of the conductive fluid are selected to obtain a desired activation sensitivity for the predetermined level of impact.

9. The impact switch of claim 7, wherein the opening comprises an angled surface to form the capillary gap.

10. The impact switch of claim 7, wherein the split etch pad is disposed over the opening.

11. The impact switch of claim 7, further comprising a cover, the first and second members slidably insertable into the cover and fixedly securable within the cover.

12. The impact switch of claim 11, further comprising a first lead connected to the first conductive portion and a second lead connected to the second conductive portion, the first and second leads extending out from the cover.

13. An impact switch, comprising:

an insert having a reservoir for holding a conductive fluid, the reservoir sized to retain the conductive fluid in the reservoir until a predetermined level of impact is received by the impact switch; and an electronic assembly disposed over an opening of the reservoir, the electronic assembly having a first conductive portion extending over a first portion of a periphery of the opening and a second conductive portion extending over a second portion of the periphery of the opening, the first and second conductive portions disconnected from each other in a non-activated state of the impact switch, and wherein the electronic assembly comprises a printed circuit board having a split etch pad, the split etch pad forming the disconnected first and second conductive portions; and wherein, responsive to receiving the predetermined level of impact, the conductive fluid moves from the reservoir to an interface between the insert and the electronic assembly and migrates along the periphery to conductively connect the first conductive portion with the second conductive portion in an activated state.

14. The impact switch of claim 13, wherein an internal bore size of the reservoir and a viscosity of the conductive fluid are selected to obtain a desired activation sensitivity for the predetermined level of impact.

15. The impact switch of claim 13, wherein a surface of the opening comprises a tapered surface.

16. The impact switch of claim 13, wherein a capillary gap is formed between the periphery of the opening and the electronic assembly such that the conductive fluid wicks into the capillary gap and migrates via capillary action along the periphery to conductively connect the first conductive portion with the second conductive portion.

17. The impact switch of claim 13, further comprising a cover, the insert and the electronic assembly slidably insertable into the cover and fixedly securable within the cover.

18. The impact switch of claim 17, further comprising a first lead connected to the first conductive portion and a second lead connected to the second conductive portion, the first and second leads electrically connectable to an external device located outside the cover.

* * * * *